US006634202B1

(12) United States Patent
Oetiker

(10) Patent No.: US 6,634,202 B1
(45) Date of Patent: Oct. 21, 2003

(54) DEVICE FOR ARRANGING, CLAMPING OR CONTRACTING A RING SHAPED SECURING MECHANISM

(75) Inventor: Hans Oetiker, Horgen (CH)

(73) Assignee: Hans Oetiker AG Maschinen-und Apparatefabrik, Horgen (CH)

( * ) Notice: Subject to any disclaimer, the term of this patent is extended or adjusted under 35 U.S.C. 154(b) by 0 days.

(21) Appl. No.: 09/806,527

(22) PCT Filed: Sep. 13, 1999

(86) PCT No.: PCT/CH99/00427

§ 371 (c)(1),
(2), (4) Date: Jun. 28, 2001

(87) PCT Pub. No.: WO00/20175

PCT Pub. Date: Apr. 13, 2000

(30) Foreign Application Priority Data

Oct. 2, 1998 (EP) ..... 98118718

(51) Int. Cl.[7] ..... B21D 41/04

(52) U.S. Cl. ..... 72/292; 72/402; 29/283.5; 29/282; 29/243.517

(58) Field of Search ..... 72/292, 402; 269/130–132; 29/283.5, 282, 243.517, 270, 224

(56) References Cited

U.S. PATENT DOCUMENTS

| | | | | | |
|---|---|---|---|---|---|
| 727,651 | A | * | 5/1903 | Loetscher | 269/130 |
| 732,309 | A | * | 6/1903 | Marshall | 269/130 |
| 788,161 | A | * | 4/1905 | Marceau | 269/130 |
| 1,213,099 | A | * | 1/1917 | Harrington | 72/292 |
| 2,335,591 | A | * | 11/1943 | Hansell | 72/292 |
| 2,674,966 | A | * | 4/1954 | Morris | 72/292 |
| 2,871,812 | A | * | 2/1959 | Pederson | 72/412 |
| 4,885,928 | A | | 12/1989 | Davis et al. | 29/237 |
| 5,598,732 | A | * | 2/1997 | Dischler | 72/402 |
| 6,058,755 | A | * | 5/2000 | Viegener | 72/292 |

FOREIGN PATENT DOCUMENTS

| | | | | |
|---|---|---|---|---|
| DE | 11 98 147 B | | 7/1959 | |
| DE | 195 37 825 | * | 12/1996 | 72/292 |
| DE | 195 47 592 A | | 3/1997 | |
| EP | 0 451 806 A1 | | 10/1991 | |
| EP | 0 791 433 A | | 8/1997 | |
| FR | 2.116.406 | * | 7/1972 | 72/402 |
| GB | 63177 | * | 4/1913 | 72/292 |
| GB | 1209650 | * | 10/1970 | 72/402 |

* cited by examiner

*Primary Examiner*—Daniel C. Crane
(74) *Attorney, Agent, or Firm*—Pearne & Gordon LLP

(57) ABSTRACT

A device for arranging, clamping or contracting a ring-shaped securing mechanism, including an open clamping ring (3) with a securing section (5, 7) at each end; and at least two ring-shaped clamping jaws (11) located inside the clamping ring. The clamping jaws rest against the clamping ring (12) with their outer edge (12) and together at least almost form a circular opening with their inner surface (19). The device also has at least one spring-type mechanism (15) being situated respectively between the laterally contiguous clamping jaws to drive them apart or to part the clamping ring in its non-clamped state, in the direction in which the ring opening diameter increases and to secure the clamping jaws in the clamping ring. The open clamping ring can be clamped in the direction in which the diameter decreases by means of a clamping mechanism with at least two engaging sections which are provide for engaging with the securing sections.

12 Claims, 4 Drawing Sheets

DEVICE FOR ARRANGING, CLAMPING OR CONTRACTING A RING SHAPED SECURING MECHANISM

BACKGROUND OF THE INVENTION

The present invention relates to a device for mounting, clamping or contracting an annular retaining element, a method for mounting, clamping or contracting an annular retaining element as well as a device for mounting locking, clamping or contract rings such as so-called multi contract rings in particular.

To mount largely circular retaining elements such as clamping, press or contract rings, in particular the very widely sold earless "Oetiker" clamp jaws, that have no elements protruding outward for arranging a corresponding mounting tool, expensive, control-intensive mounting arrangements are used. Installations are known in particular from the auto industry for contracting so-called multi-crimp rings in drive shafts and steering gears, for arranging protective rubber joints to ensure lubrication of the joints.

Thus, for example, press rings are contracted by a number of pressing jaws arranged circularly and preferably able to be actuated hydraulically or pneumatically in order to firmly mount sleeved rubber joints over a drive shaft, for example. These known mounting arrangements are suitable for automated mounting of drive shafts and/or steering gears on the automobile mounting line.

In connection with repairs on drive shafts, steering gears or so-called clamping connections that are equipped with what are referred to as multi-crimp rings as connecting elements, to this day there is no device that is designed in the form of a manual tool in order to be used at any time on site for contracting the aforementioned multi-crimp rings (MCR). Nor are there any known mounting arrangements for the mounting of drive shafts and steering gears for very small series assemblies. It is also important for such an mounting installation to be operable without additional hydraulic or pneumatic peripherals in order to dispense with the infrastructure required for this.

In EP 0 451 806 a clamping tool is proposed for connecting tubular work-pieces. They are connected by means of more than two curved dies that can be swung apart on axles and/or can be pushed apart by press rings and tension belts provided, so that they can be pushed over the tube ends. By attaching drive means, the curved dies are drawn together in the closing direction so that they connect the tube ends together by means of connecting sleeves.

BRIEF SUMMARY

It is a technical problem the present invention to create a device for mounting, clamping or contracting an annular retaining element that is preferably able to be operated by hand and is also suitable in particular for carrying out repairs and/or for only mounting individual retaining elements and/or for individual assemblies.

According to the invention, the technical problem posed is solved by means of a device according to claim 1 particular.

A device for mounting, clamping or contracting an annular retaining element is proposed that is characterized by:

an open clamping ring or clamping band with a retaining section at each end, at least two annularly curved clamp jaws laterally abutting as far as possible, mounted inside the clamping ring, resting with their outer annular contour against the clamping ring, and together forming an at least almost circular ring opening with their inner annular surface, at least one spring-like element between laterally abutting clamp jaws to push them away from each other or to open up the clamping ring in unclamped status in the direction enlarging its diameter and hold the clamp jaws firmly in the clamping ring, and a clamping element provided with at least two gripping sections in order to grip the retaining sections and clamp the open clamping ring in the diameter-reducing direction.

Preferred forms of construction of the device according to the invention are characterized in the subclaims.

Furthermore, a method is disclosed for mounting, clamping or contracting an annular retaining element, such as clamping ring, press ring or contract ring, that is characterized in that the retaining element is arranged within a number of clamp jaws arranged largely circularly, and these clamp jaws together form with their inner surfaces a largely circular ring opening and are laterally pushed away from each other by a spring-like element providing spacing between two clamp jaws or clamping segments, and then an open clamping ring clasping the outside of the clamp jaws and holding them is clamped by means of a clamping element in the diameter-reducing direction, in order to move the clamp jaws pushing them largely radially and vertically inward and clamp and/or contract the retaining element such as a press ring, clamping ring or contract ring, if necessary on an object to be arranged and or defined.

The device as well as the method defined according to the invention are particularly well suited to contract clamping, press or contract rings, such as the so-called multi-crimp rings.

BRIEF DESCRIPTION OF THE DRAWINGS

The invention will be explained in more detail below in examples and referring to the attached figures.

The following are shown.

DETAILED DESCRIPTION OF THE INVENTION

Figure 1:
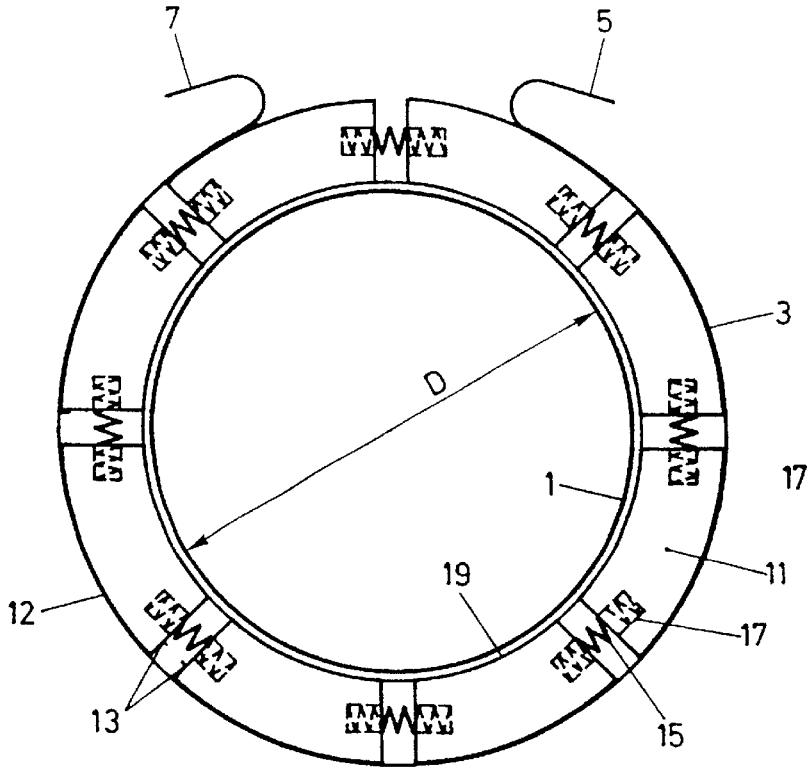
FIG. 1 an arrangement according to the invention in a side view in unclamped status, provided in order to mount a contract ring, FIG. 2 the arrangement from FIG. 1 in clamped status with contracted contract ring, FIG. 3 a clamp jaw of the device from FIGS. 1 and 2, in a side view, FIG. 4 in cross-section, the clamp jaw from FIG. 3 along line I—I, FIG. 4*a* a cutout from FIG. 4, FIG. 5 in cross-section, the clamp jaw from FIG. 3 along line II—II, FIG. 6 a clamping ring of an arrangement according to FIGS. 1 and 2, suitable for driving the clamp jaws together in a manner reducing the diameter, FIG. 7 a clamping tool suitable for clamping the clamping ring or clamping belt of the device according to FIG. 1 or 2, FIG. 8 in side view, a section of a drive shaft surrounded on the outside with a flexible rubber joint, mounted with so-called contract rings, and FIG. 9 in exploded view, and schematically, the mounting procedure for a contract ring when mounting a bellows joint for binding a shaft end of a drive shaft.

FIG. 1 shows a side view of a clamping arrangement according to the invention, for mounting or contracting a press or contract ring, for example. In this connection, the clamping or press or contract ring 1 to be arranged on any object to be mounted is arranged inside the device according to the invention, and the clamping or press or contract ring has the diameter D. The clamping device is in the unclamped status and has the following parts:

An outer, surrounding, open clamping ring or a clamping belt 1 with the open, curved ends 5 and 7, suitable for grasping and gripping a clamping tool.

Several clamp jaws or clamping segments 11, arranged annularly and resting with their outer surfaces 12 on or against the inside of the clamping ring or clamping belt 3, form with their inner surface 19 a largely circular ring opening. The individual clamp jaws or clamping elements 11 are each laterally spaced from each other by a gap that is formed by springs 15 arranged between each of the clamp jaws or clamp segments and by means of which the clamp jaws are pushed away from each other. These springs 15 are each mounted or held in hole-like recesses 17 in the side surfaces 13 of the clamp jaws or segments 11. With these springs, it is further ensured that the-eight according to the illustration in FIG. 1—mounted clamp jaws or segments are held firmly within the clamping ring or clamping belt 3.

By using a clamping tool, e.g. one having the two pincer-like legs 31 and 33, to grip the curved ends 5 and 7, the clamping ring or clamping belt 3 is clamped in the diameter-reducing direction, whereby on the one hand the clamp jaws are each driven laterally against the spring force of the springs 15 and are also moved radially and vertically inward. By means of this inward movement of the individual clamp jaws or clamping segments 11, the diameter of the inner ring opening formed by the clamp jaws is also reduced, of course, whereby the press or contract ring 1 is then compressed or contracted and then has a diameter D', substantially smaller than the original diameter D. It has been shown in practical experience that diameter reductions of approx. 3 mm can be achieved, in connection with which the size of the reduction is naturally also dependent on the size of the clamping device. Greater diameter reductions can also be achieved, of course, by means of larger clamping devices.

During the clamping process, the circle is closed or, respectively, the diameter D' is attained only when the clamp jaws are arranged resting completely against each other, or the clamp jaws are closed. In this connection, it has been shown that when clamping the clamping ring, first the lower jaws are closed and only after this are the upper jaws consecutively closed to form the definitively closed circle.

Figure 3:
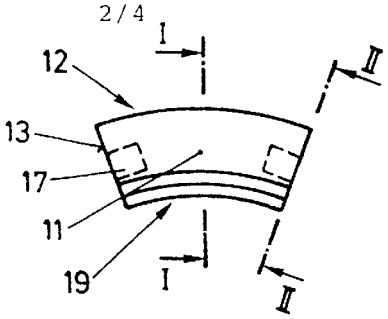
Figure 4:
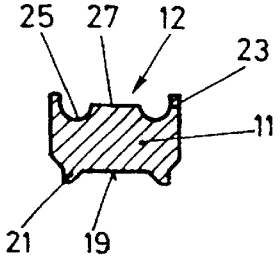
Figure 5:
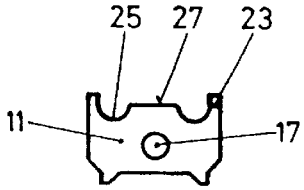

FIGS. 3 through 5 are referred to in order to show how on the one hand, the contract ring or press ring 1 or 1' is held inside the clamping device and on the other hand, how the clamp jaws or clamping segments 11 are held inside the clamping ring or clamping belt 3. In this connection, FIG. 3 shows an individual clamp jaw or clamping element 11, FIG. 4 shows a section of the segment from FIG. 3 along line I—I and FIG. 5 shows a section along line II—II of the segment or the clamp jaw from FIG. 3.

Figure 4A:
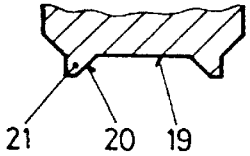

It is now clearly recognizable in FIG. 4 that the outer surface 12 as well as the inner surface 19 of the jaw or segment 11 are designed such that on the one hand, the clamp jaw 11 is held in a manner resistant to lateral slipping inside the clamping ring 3, and on the other hand, the press ring or contract ring 1 is held, resistant to lateral slippage, inside the annular opening of the clamping device. Thus, the inner surface 19 has guide rails or edges 21 on each side, within which the press ring or contract ring to be compressed is held. In this connection, it is, recognizable in particular in FIG. 4*a* that the side flank—facing the inner surface 19—of each of the two edges 23 is designed running conically diagonal, in order to prevent the ring from widening during contracting. These edges are used to cause the thickness of the ring to increase slightly during the contracting process, which is advantageous. The outer surface 12 in turn has guide rails or edges 23 on each of its sides as well as an inner sliding surface 27, which is kept at a distance from the lateral guide rails 23 by longitudinal grooves 25 protruding inward. With the design of the outer surface with reduction of the support surface, a better sliding of the clamping ring 3 on the outer surface 12 of the clamp jaws or clamping elements 11 is additionally achieved. In addition, the surface 27 designed belt-like in the middle can be provided with a friction-reducing coating to allow smooth sliding during the pressing or clamping procedure. Of course, the better sliding can also be achieved by providing lubricants, lubricating oil, etc.

FIG. 5 shows the lateral face 13 of a clamp jaw or a clamping segment 11, and in the face the recess 17 can be seen in which the springs arranged between two clamp jaws are held.

Figure 6:
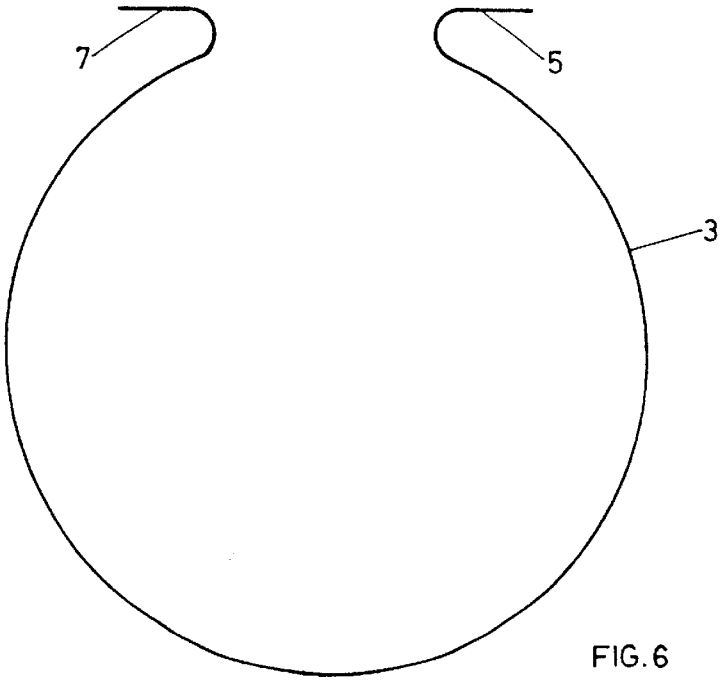

FIG. 6 in turn shows a clamping ring or a clamping belt 3 with the outward bent ends 5 and 7, provided for gripping a clamping tool.

Figure 7:
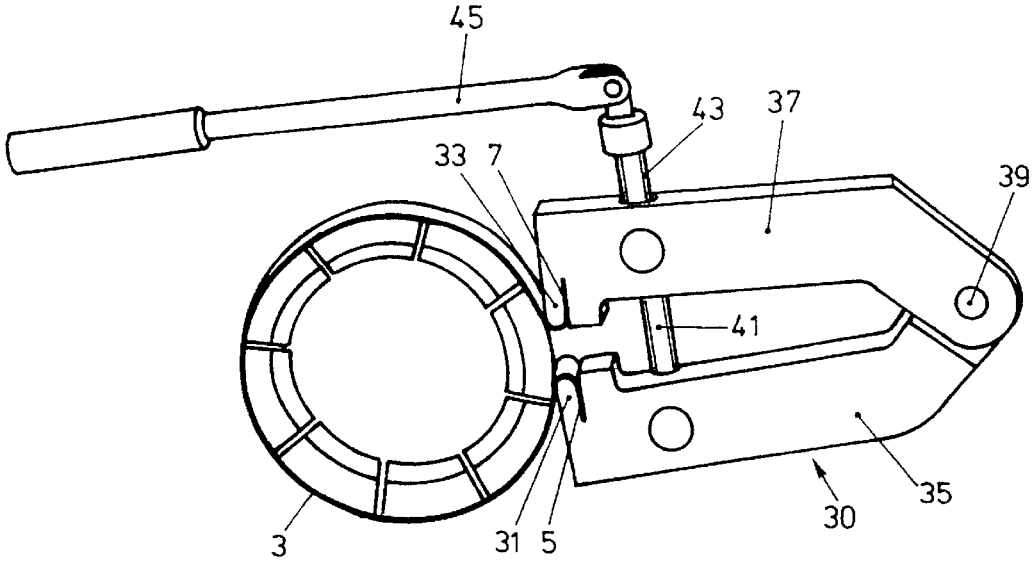

FIG. 7 then shows how a clamping device can be clamped by means of a clamping tool in order to mount the press ring or contract ring. As we already started to illustrate in FIG. 2, the section at the ends 5 and 7 of the clamping ring 3 can be engaged by means of a clamping tool 30 and corresponding pincer-like legs 31 and 33. So that the bent ends 5 and 7 are securely held in the clamping tool, slits can also be placed in the end sections of the legs 31 and 33, into which the belt ends grip.

According to FIG. 7, the clamping tool consists of on the one hand of the end sections 31 and 33, provided in order to engage the ends 5 and 7 of the clamping ring, and the two legs 35 and 37 that are joined together pivoting around a connecting axis 39.

By means of a threaded spindle 41 having the thread 43 that engages the leg 37 in a corresponding thread bore, the two legs 35 and 37 can be actuated by actuating a screw grip, for example, or if desired, by means of a dynamometric key 45. The force by means of which the two legs 35 and 37 are pushed together and the clamping ring 3 of the device is thus clamped depends on the sizing of the clamping tool or the setting of the dynamometric key.

Figure 2:
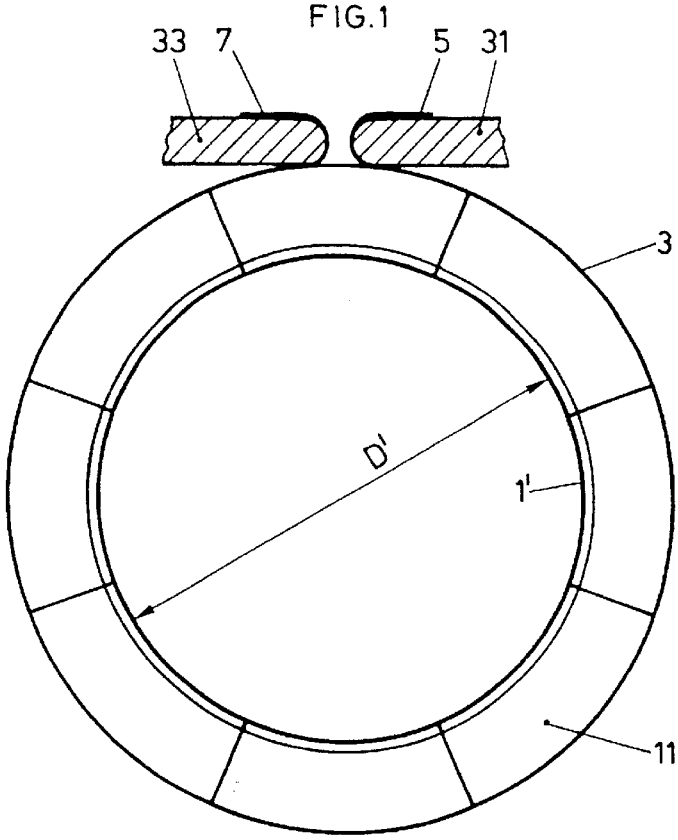

Of course, the clamping tool using a dynamometric key or screw grip with joint is only one example of clamping the clamping device according to FIG. 1 and 2. Any other suitable clamping tools, pincer-like ones for example, or even hydraulically or pneumatically operated clamping tools can be used for clamping the clamping ring. The spindle shown in FIG. 7 can of course be replaced by any other suitable actuation mechanism such as hydraulically or pneumatically operating cylinders. Such an actuator can be hand-operated and can also motor-driven. In other words, the present invention is naturally not limited to the spindle shown in FIG. 7.

Figure 8:
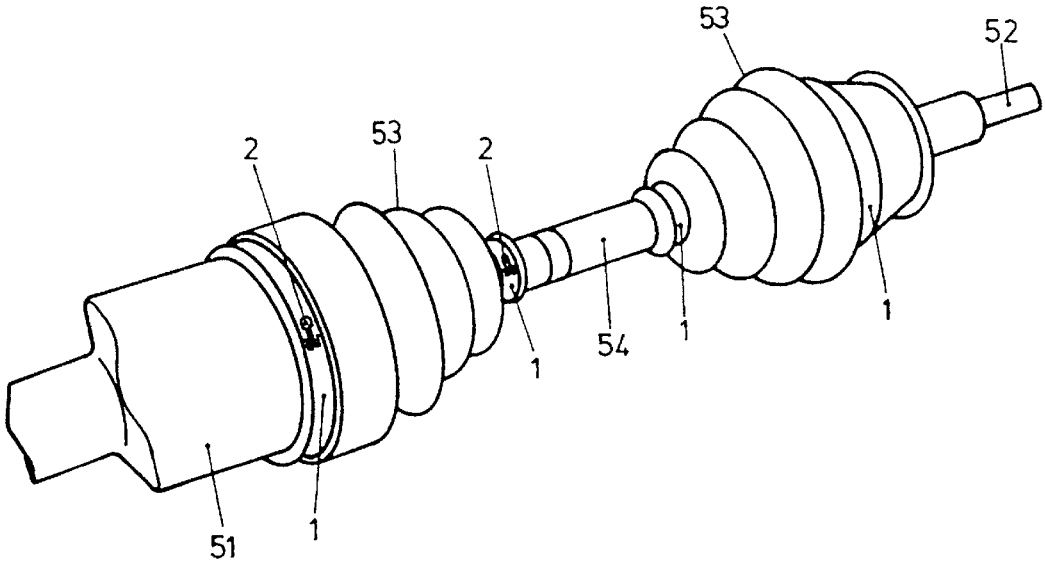

FIG. 8 shows an example of application in which so-called press rings or contract rings are used that do not have any parts nor contact surfaces protruding outward. The advantage of such "earless" or "stage-less" press rings or contract rings is in the fact that they cannot cause imbalance during rotation.

In this connection, FIG. 8 shows a rear axle shaft or a drive shaft between the drive shaft 51 and the wheel hub 52, which is protected by two rubber joints. On an inner drive shaft 51, a contract ring or press ring 1 is mounted in order to hold the joint 53 on the shaft end. The seam 2 can be clearly seen on the contract ring or press ring 1; it is either already firmly connected before the contract ring or press ring is attached or it is attached during the compression step.

At the other end, the rubber joint 53 is held on the connecting shaft or drive shaft 54 by means of a contract ring or press ring 1. Similarly, the connection joint placed between the connection shaft 54 and the wheel hub 52 is in turn protected by means of a rubber joint 53 that is once again attached or secured by means of contract rings or press rings 1. With such drive shafts, it is then possible that in case of repair work or when replacing an entire drive shaft, any information such as repair details, mounting data, etc. can be punched in on a press ring or contract ring contracted according to the invention, such that this information is available on site and at any time later. If necessary, an already mounted press ring or contract ring can be removed and replaced with a new one without the entire drive shaft or the joint having to be removed. Already mounted press rings or contract rings could thereby be replaced at any time, if the information recorded there needs to be updated or replaced, for example.

Figure 9:
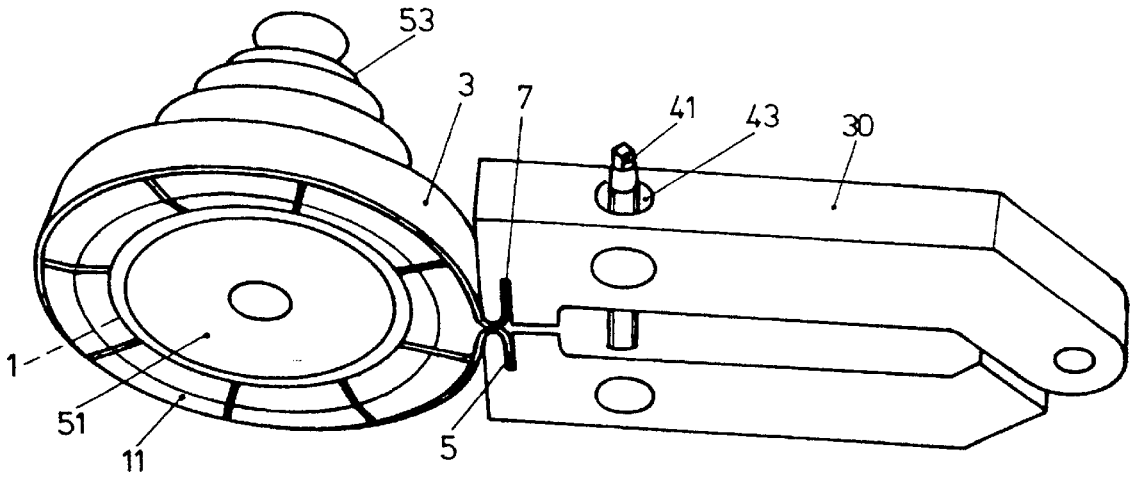

Lastly, FIG. 9 shows the mounting procedure for a contract ring or press ring 1 (not shown) on a shaft end 51 by means of a clamping device according to the invention. In this connection, the tension belt or clamping belt 3 is clamped by means of a clamping tool 30 in that the two ends 5 and 7 of the tension belt or clamping belt 3 are clamped. As already mentioned with reference to FIG. 7, the clamping process takes place by means of a threaded spindle 41 that engages with a thread 43 in a corresponding thread bore in one of the two legs of the clamping tool 33.

In particular in connection with repairs on drive shafts, steering gears or other clamping connections that are equipped with so-called multi-crimp rings (MCR) as connection elements, for example, the tension or clamping device illustrated according to the invention—which can be designed in particular in the form of a hand tool—is suitable for use at any time on site to contract MCRs. The device according to the invention can also be used for small series assemblies. It is also important that such a device according to the invention can be operated in the basic design without additional hydraulic or pneumatic peripheral devices. To be able to monitor a closing force defined for each MCR in the case of a hand-operated contracting procedure, there is the possibility to also use a dynamometric key calibrated for the device, instead of the screw key. Even with this simple device there is thus the possibility to monitor the contracting force in a manner comparable to that of industrial contracting installations. In addition, the contracting path differing depending on each MCR size can also be monitored, since the device according to the invention is calibrated for the different diameters, i.e., can be equipped with different closing segments that are drawn together in the smallest possible diameter by the device and the clamping belt. As already mentioned above, diameter reductions of approx. 3 mm and more can easily be achieved.

The clamping tool preferably has a pair of clamping legs with hinge and right or left-acting threaded spindle as well as receiving slots for that clamping belt ends 5 and 7. The clamping tool is driven by means of a screw grip or preferably with a dynamometric key via the threaded spindle. With respect to FIG. 9 as well, it should be emphasized once again that of course, any other suitable drive can be used for clamping the clamping tool instead of a threaded spindle, such as a hydraulic or pneumatic cylinder, for example. The clamping procedure itself can be carried out either hand-operated or by means of a motorized drive.

The clamping device itself consists of two or more clamp jaws or closing segments, in connection with which eight such segments are shown according to the examples in FIGS. 1 through 9. The segments should be sized and/or selected so as to allow a closing path of approx. 3 mm in diameter. The individual segments have side edges that laterally position the MCR during the closing step. The clamping belt or clamping ring holds the closing segments, such as the eight segments in FIGS. 1 through 9, together as a unit. Adaptation to the individual MCR diameters can take place by replacing the closing segments.

The clamping tool or the clamping device is designed such that it can be securely clamped in the area of one of the clamp jaw legs in order to work against the lateral forces arising during the closing process due to the movement of the screw grip.

The clamping devices illustrated in FIGS. 1 through 9 are of course only examples, that can be altered, completed or modified in any desired manner. It is thus basically a question of optimization, whether two, three, five, eight or even more clamp jaws or clamping segments are used. The springs shown in the figures between the individual clamping segments can also be replaced with other spring-like elements that push the laterally abutting clamp jaws away from each other. The material is not a primary concern, either; tempered steel certainly should be in the foreground as a rule but aluminum or even reinforced plastics are quite conceivable depending on the application.

The widest variety of clamping tools can also be used for clamping the clamping device, e.g. any pincer-like tools or even hydraulically or pneumatically operated elements that are appropriate to push the open ends of the clamping ring toward each other.

What is claimed is:

1. Device for mounting, clamping or contracting an annular retaining element, the device comprising an open clamping ring (3) prestressed in a closing direction, with a retaining section (5, 7) at each end, at least two annularly curved clamp jaws (11) largely laterally abutting, mounted inside the clamping ring, resting with their outer, annular contour (12) against the clamping ring, and together forming at least an almost circular ring opening with an inner, annular surface (19), at least one spring-like element (15) between laterally abutting clamp jaws to push them away from each other and to open up the clamping ring in unclamped status in the direction enlarging the ring opening diameter and holding the clamp jaws firmly in the inwardly prestressed clamping ring, wherein all the clamping jaws are independently retained within the clamping ring by the inward prestressing of the clamping ring and outward pushing of the spring-like element on the clamp laws, and a clamping element (30) provided with at least two gripping sections (31, 33) in order to grip the retaining sections and clamp the open clamping ring in the diameter-reducing direction.

2. Device according to claim 1, wherein the clamp jaws have an outer surface provided in order to rest on and/or against the clamping ring, each clamp jaw having lateral guiding edges (23) to laterally guide and hold the clamp jaws on and/or against the clamping ring, the guiding edges being spaced such that the clamping ring can slide freely on the outer surface of the clamp jaws.

3. Device according to one of claims 1 or 2, wherein the inner surfaces (19) of each of the clamp jaws that together form a nearly circular ring opening have guide edges (21) each protruding laterally and an inner side flank (20) of each guide edge facing the inner surface is designed running diagonally or conically inward, in order to prevent the element's belt width from widening during the contracting or clamping of the annular retaining element.

4. Device according to claim 2, wherein the outer surface of the clamping jaws has a support surface (27) for supporting the inside of the clamping ring, the support surface being separated from the guiding edges by grooves (25) protruding laterally into each of the clamp jaws in the longitudinal direction of the clamping ring, and the surface or support surface (27) is coated and/or provided with a friction-reducing material.

5. Device according to claim 1, 2 or 4, characterized in that the clamp jaws each have one or more recess/es or bore/s (17) directed toward an adjacent clamp in or on the front or side surface (13), to receive the spring-like elements (15), and each two abutting clamp jaws have two recesses or bores aligned with each other such that the respectively arranged spring-like element/s can exert a largely perpendicular force on the lateral surface of the respective clamp.

6. Device according to claim 1, 2 or 4, wherein at least three clamp jaws or clamp segments are provided.

7. Device according to claim 1, 2 or 4, wherein the clamping element (30) has at least two pincer-like clamping legs (35, 37) each with a gripping section to grip the retaining sections as well as an element (41, 43) producing a force component to drive the two legs toward each other to clamp the clamping ring.

8. Device according to claim 7, wherein the element producing the force component has a thread spindle, or other means by which the two legs can be moved toward and/or away from each other, and an element for moving the threaded spindle, or the other means.

9. Device according to claim 7, wherein the clamping element is actuated pneumatically and/or hydraulically.

10. Method of mounting, clamping or contracting an annular retaining element, such as a press ring, a clamping ring or contract ring, by means of a device comprising an open clamping ring (3) prestressed in a closing direction, with a retaining section (5, 7) at each end, at least two annularly curved clamp jaws (11) largely laterally abutting, mounted inside the clamping ring, resting with their outer, annular contour (12) against the clamping ring, and together forming at least an almost circular ring opening with an inner, annular surface (19), at least one spring-like element (15) between laterally abutting clamp jaws to push them away from each other and to open up the clamping ring in unclamped status in the direction enlarging the ring opening diameter and holding the clamp jaws firmly in the inwardly prestressed clamping ring, wherein all the clamping jaws are independently retained within the clamping ring by the inward prestressing of the clamping ring and outward pushing of the spring-like element on the clamp laws, and a clamping element (30) provided with at least two gripping sections (31, 33) in order to grip the retaining sections and clamp the open clamping ring in the diameter-reducing direction, comprising the steps of:

arranging the retaining element within at least two clamp laws;

forming a largely circular ring opening with inner surfaces of the clamp laws and providing spacing between two clamp laws by a spring-like element that laterally pushes the two clamp laws away from each other;

clasping the outside of the clamp laws and holding them by an open clamping ring, clamping the open clamping ring by means of a clamping element, and moving the clamp laws in the diameter reducing direction by pushing the clamp jaws largely radially and vertically inward to clamp and/or contract the retaining element on an object.

11. Method according to claim 10, wherein to clamp the clamping element, two pincer-like legs are moved toward each other by means of a threaded spindle in the direction closing the pincers and the threaded spindle is actuated by means of a screw handle.

12. Method according to claim 10, wherein the clamping element is actuated pneumatically and/or hydraulically.

* * * * *

UNITED STATES PATENT AND TRADEMARK OFFICE

CERTIFICATE OF CORRECTION

PATENT NO. : 6,634,202 B1
DATED : October 21, 2003
INVENTOR(S) : Hans Oetiker

It is certified that error appears in the above-identified patent and that said Letters Patent is hereby corrected as shown below:

Column 1,
Line 53, please delete "problem the present", and insert therefor -- problem of the present --.
Lines 59-61, please delete the paragraph starting with "According to the invention".

Column 8,
Lines 24, 26, 27, 28 30 and 34, please delete "clamp laws", and insert therefor -- clamp jaws --.

Signed and Sealed this

First Day of June, 2004

JON W. DUDAS
*Acting Director of the United States Patent and Trademark Office*